US010471317B2

(12) United States Patent
Sood

(10) Patent No.: US 10,471,317 B2
(45) Date of Patent: Nov. 12, 2019

(54) ERGONOMIC TOWEL-BASED CLEANING APPARATUS

(71) Applicant: Promod Sood, Morganville, NJ (US)

(72) Inventor: Promod Sood, Morganville, NJ (US)

( * ) Notice: Subject to any disclaimer, the term of this patent is extended or adjusted under 35 U.S.C. 154(b) by 171 days.

(21) Appl. No.: 15/722,604

(22) Filed: Oct. 2, 2017

(65) Prior Publication Data

US 2018/0093147 A1 Apr. 5, 2018

Related U.S. Application Data

(60) Provisional application No. 62/402,356, filed on Sep. 30, 2016.

(51) Int. Cl.

| | |
|---|---|
| ***A63B 57/60*** | (2015.01) |
| ***A63B 60/36*** | (2015.01) |
| ***A47L 13/18*** | (2006.01) |
| *A63B 55/00* | (2015.01) |

(52) U.S. Cl.

CPC ..... *A63B 57/60* (2015.10); *A47L 13/18* (2013.01); *A63B 60/36* (2015.10); *A63B 55/408* (2015.10)

(58) Field of Classification Search

CPC ..... A63B 57/60; A63B 60/36; A47L 13/18; A47L 13/10

See application file for complete search history.

(56) References Cited

U.S. PATENT DOCUMENTS

| | | | | |
|---|---|---|---|---|
| 3,643,386 | A * | 2/1972 | Grzyll | A41D 19/0055 15/227 |
| 5,813,080 | A | 7/1998 | Hendren | |
| 5,979,007 | A | 11/1999 | Soon | |
| 7,302,728 | B2 | 4/2007 | Kunz | |
| 7,797,783 | B2 | 9/2010 | Chandler et al. | |
| 8,544,135 | B2 | 10/2013 | Scott et al. | |
| 2006/0075589 | A1 | 4/2006 | Choi | |
| 2011/0258755 | A1 * | 10/2011 | Arfi | A47L 13/18 2/161.6 |

FOREIGN PATENT DOCUMENTS

| | | |
|---|---|---|
| GB | 2368536 | 10/2004 |
| KR | 2020120005815 | 8/2012 |

* cited by examiner

*Primary Examiner* — Shay Karls

(74) *Attorney, Agent, or Firm* — Gearhart Law LLC

(57) ABSTRACT

Methods and devices for cleaning materials are provided. The device may include a cloth having a first textured surface and a second textured surface with the second textured surface being coarser than the first textured surface, and a compartment housed in the cloth having an opening on the outside of the cloth. The compartment is configured to enclose a hand of a user, and wherein the second surface is positioned on the outside of the cloth over portions of the compartment configured to house a thumb and at least one finger of the hand of the user.

16 Claims, 10 Drawing Sheets

ERGONOMIC TOWEL-BASED CLEANING APPARATUS

CLAIM OF PRIORITY

This application claims priority to U.S. Application 62/402,356 filed on Sep. 30, 2016 the contents of which are herein fully incorporated by reference in its entirety.

FIELD OF THE EMBODIMENTS

The field of the embodiments of the present invention relate to cleaning apparatuses and, in particular, to cloth cleaning apparatuses having built-in compartments for the insertion of hands.

BACKGROUND OF THE EMBODIMENTS

Golf has been a past-time for many hundreds of years. One of its many benefits is providing people with the ability to exercise and socialize while, at the same time, enjoying being outdoors on the grass. However, playing on grass (or dirt, sand, water, or any other feature of the golf course) causes golf clubs (and, particularly, club faces) to get dirty over time, requiring them to be cleaned.

For cleaning golf clubs while on the course, towels and other cloths are beneficial in that they are lightweight and can typically fit inside the average golf bag. In fact, many golf bags have hooks, loops, pockets, or other areas designated specifically for golf towels. Many golf towels have coarse surfaces, for cleaning the clubs, and smoother surfaces, for drying the clubs.

These towels, however, have a particular disadvantage; that the golfer must first locate, the coarse surfaces, then position the coarse surfaces over the desired portions of the club for cleaning, then clean the club. It is time consuming and delays the playing of the sport. An easier method/apparatus for golfers to clean their clubs while playing is thus needed.

Examples of related art are described below:

U.S. Pat. No. 5,813,080 pertains to an improved hand-held towel structure suitable for cleaning and drying athletic apparatus and other implements in wet weather. The towel structure includes an outer layer of towel material having a first predetermined absorbency which is separated from an inner layer of wiping material having a second predetermined absorbency by a film layer that substantially inhibits transfer of water from the towel material to the wiping material. The improved towel structure is arranged such that the outer layer of towel material may be utilized for wiping and cleaning the athletic equipment or other implements, while the film layer inhibits transfer of any soil or water to the inner wiping layer. The structure substantially defines an inner pocket open at the bottom in which the athletic equipment or other implements can be inserted for further wiping and drying. Various structures for retaining the elements of the towel structure in position relative to each other are described.

U.S. Pat. No. 5,979,007 pertains to a towel mitt for washing that includes a first layer of material and a second layer of material juxtaposed on the second layer of material and forms therewith a hand receiving pocket for receiving a hand of a user. The first and second layers of material have pile outer faces for delicate washing and abrasive inner faces for more abrasive cleaning and for increasing friction between the hand of the user and the towel mitt so as to prevent unintentional dropping of the towel mitt. The hand receiving pocket is symmetrical relative to the longitudinal centerline of the towel mitt so as to allow the towel mitt to be used on either hand without discomfort, and is defined by stitching that is inward of the edges of the first and second layers of material so as to form flaps that when flipped above expose the abrasive inner faces of the first and second layers of material for utilization when more abrasive cleaning is required.

U.S. Pat. No. 7,302,728 pertains to a cleaning implements for golfers that comprise towels and gloves including abrasive portions for removal of dirt, grass, grass stains, and scuff marks from golf balls, golf clubs, and other golfing equipment. There is disclosed a towel which may include a pocket portion provided with adjacent, but slightly spaced portions or strips of an abrasive material disposable in overlying relationship for use in removing soil from balls and clubs. The towel comprises an attaching mechanism for the purpose of securing the towel to a golf cart or golf bag. The glove or towel according to the disclosure may include portions adapted for treatment, wetting, or impregnation with cleaning or polishing fluids or compounds.

U.S. Pat. No. 7,797,783 pertains to a golf grip towel constructed of at least two panels of different materials that provides for a dual purpose towel and protective cover for the handles of golf clubs. When the golf clubs are removed from the golf bag or golf cart for use on a fairway or green, the handles of the clubs are placed in a pocket of the golf grip towel to protect the golf club handles, when laid on the ground, from moisture, dirt, or other contamination.

Great Britain Patent No. GB2368536B pertains to a golf ball cleaning and drying aid in the form of a golf towel, a part of the golf towel including a cleaning station for a golf ball, the cleaning station comprising a receptacle for a golf ball, the receptacle for the golf ball having an inlet and an outlet whereby a golf ball may be passed from the inlet to the outlet, the outlet opening out onto the golf towel, the receptacle further comprising a strip of toweling material attached to the golf towel, the strip of toweling material having sufficient length and breadth so as to provide an adequate margin on either side of a golf ball placed in the receptacle to allow the golf ball to be manipulated within the receptacle thereby to clean the golf ball.

None of the art described above addresses all of the issues that the present invention does.

SUMMARY OF THE EMBODIMENTS

According to an embodiment of the present invention, a cleaning apparatus is provided. The cleaning apparatus includes: a cloth having a first textured surface and a second textured surface, wherein the second textured surface is coarser than the first textured surface; and a compartment housed in the cloth having an opening on the outside of the cloth, wherein the compartment is configured to enclose a hand of a user, and wherein the second surface is positioned on the outside of the cloth over portions of the compartment configured to house a thumb and at least one finger of the hand of the user.

It is an object of the present invention to provide for the cleaning apparatus, wherein the compartment is in the shape of a mitten.

It is an object of the present invention to provide for the cleaning apparatus, wherein the compartment is in the shape of a glove.

It is an object of the present invention to provide for the cleaning apparatus, wherein the cloth includes a toweling material.

It is an object of the present invention to provide for the cleaning apparatus, wherein the second textured surface is positioned over the first textured surface.

It is an object of the present invention to provide for the cleaning apparatus, wherein the second textured surface is positioned on a first side of the cloth and a second side of the cloth.

It is an object of the present invention to provide for the cleaning apparatus, wherein, on a first side of the cloth and on a second side of the cloth, the second textured surface is positioned on the outside of the cloth over the portions of the compartment configured to house the thumb and at least one finger of the hand of the user.

It is an object of the present invention to provide for the cleaning apparatus, wherein the compartment includes an inner lining, and wherein the inner lining includes a waterproof material.

It is an object of the present invention to provide for the cleaning apparatus, wherein the cleaning apparatus further includes a handle coupled to the cloth, wherein the handle is of a sufficient length to enable the user to pull a portion of the cloth through an opening formed by the handle.

DESCRIPTION OF THE PREFERRED EMBODIMENTS

Figure 1:
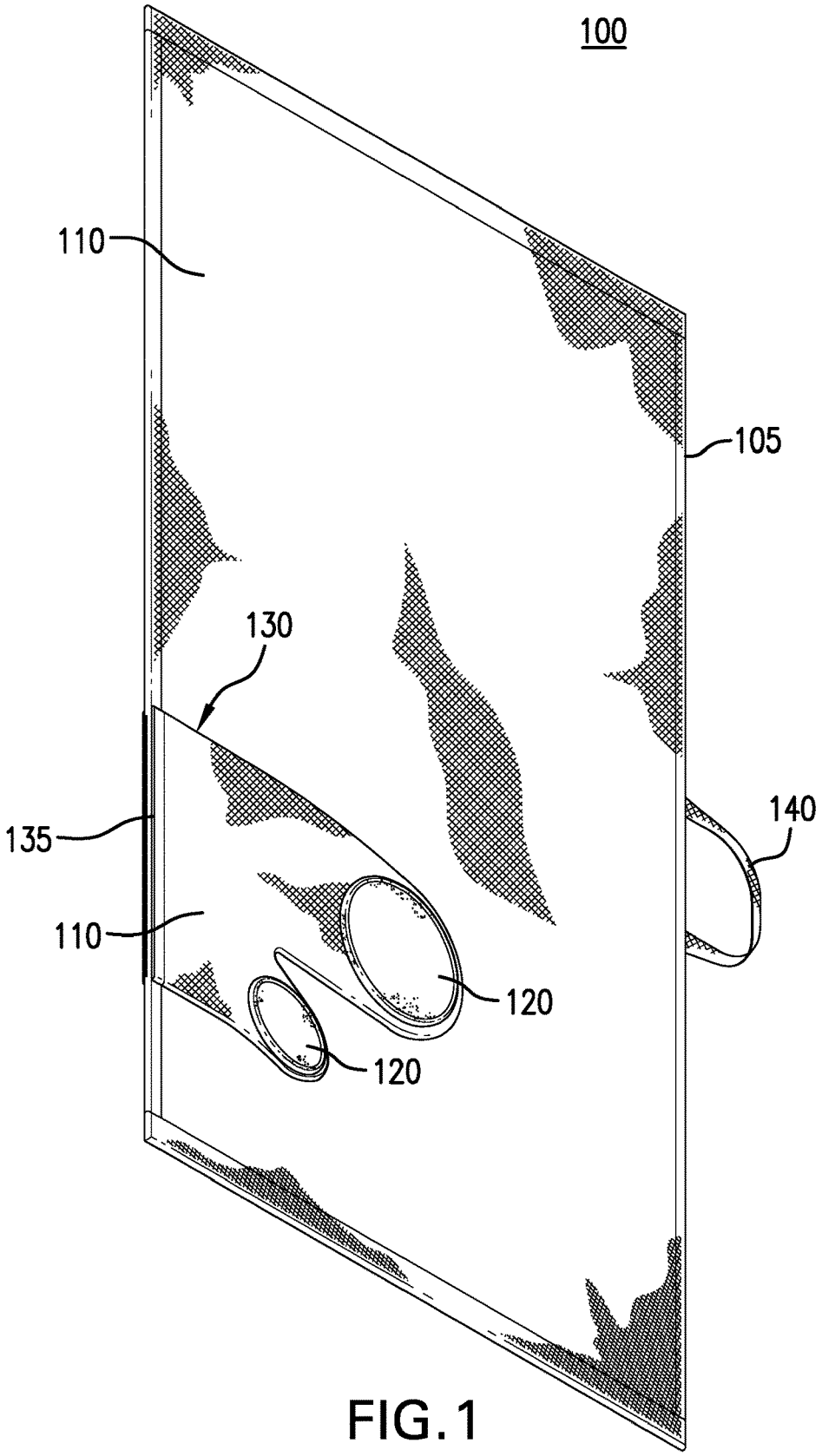
FIG. 1 shows a perspective view of a cleaning apparatus, according to an embodiment of the invention.

According to various embodiments of the present invention, a cleaning apparatus is provided, wherein the cleaning apparatus includes a compartment housed in a cloth, having an opening on the outside of the cloth, and wherein the compartment is configured to enclose a hand of a user.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Referring now to FIG. 1, a perspective view of a cleaning apparatus 100 is illustratively depicted, in accordance with an embodiment of the present invention.

According to an embodiment, the cleaning apparatus 100 includes a cloth 105 having a first textured surface 110 and a second textured surface 120. According to an embodiment, the second textured surface is coarser than the first textured surface. According to various embodiments, the second textured surface 120 includes a material different from at least one of the materials in the first textured surface 110. According to an embodiment, the second textured surface 120 may be an abrasive. In yet another embodiment, the second textured surface 120 is a polishing-type cloth. In some embodiments, the second textured area 120 is an abrasive surface on one side of the cleaning apparatus 100 and on a second side of the cleaning apparatus 100, the second textured surface 120 is a polishing surface. Each surface may be used for different materials to be cleaned or may be used in cumulative when cleaning a singular material. One or more components of the cleaning apparatus may be composed of a cloth material, such as, for example, toweling material. However, other materials having similar qualities may also be used, while maintaining the spirit of the present invention.

According to an embodiment, the cleaning apparatus 100 includes a compartment 130 housed within the cloth 105. According to an embodiment, the compartment 130 is stitched into the cloth 105. However, other methods of forming the compartment 130 within the cloth 105 may also be used, while maintaining the spirit of the present invention.

According to an embodiment, the compartment 130 is configured to house the hand of a user, and has an opening 135 for the insertion of the hand. According to the embodiment shown in FIG. 1, the compartment 130 is in the shape of a mitten. However, other suitable shapes, such as the shape of a glove, may also be implemented into the compartment 130.

According to an embodiment, the second textured surface 120 is positioned over the compartment 130. According to an embodiment, the textured surface 120 is positioned over portions of the compartment 130 designated for the thumb and at least one finger of the user. This enables the user, after inserting a hand into the compartment 130, to rub the coarser-textured or polishing second textured surface 120 against any items that are being cleaned by the cleaning apparatus 100. The first textured surface 110, being less coarse than the second textured surface 120, may be used for drying. However, the first textured surface 110 may be used for other purposes, while maintaining the spirit of the present invention.

According to an embodiment, the compartment 130 includes an inner lining. The inner lining may be made from one of the same materials as the cloth 105, or may include one or more different materials. According to an embodiment, the inner lining may include a waterproof material. This waterproof materials may create a waterproof seal thereby preventing a user's hand from becoming wet with water, cleaning materials, etc.

According to an embodiment, the cleaning apparatus 100 includes one or more handles 140, coupled to the cloth 105. According to an embodiment, the handle 140 is of a sufficient length to enable the user to pull a portion of the cloth 105 through an opening formed by the handle 140.

Figure 2:
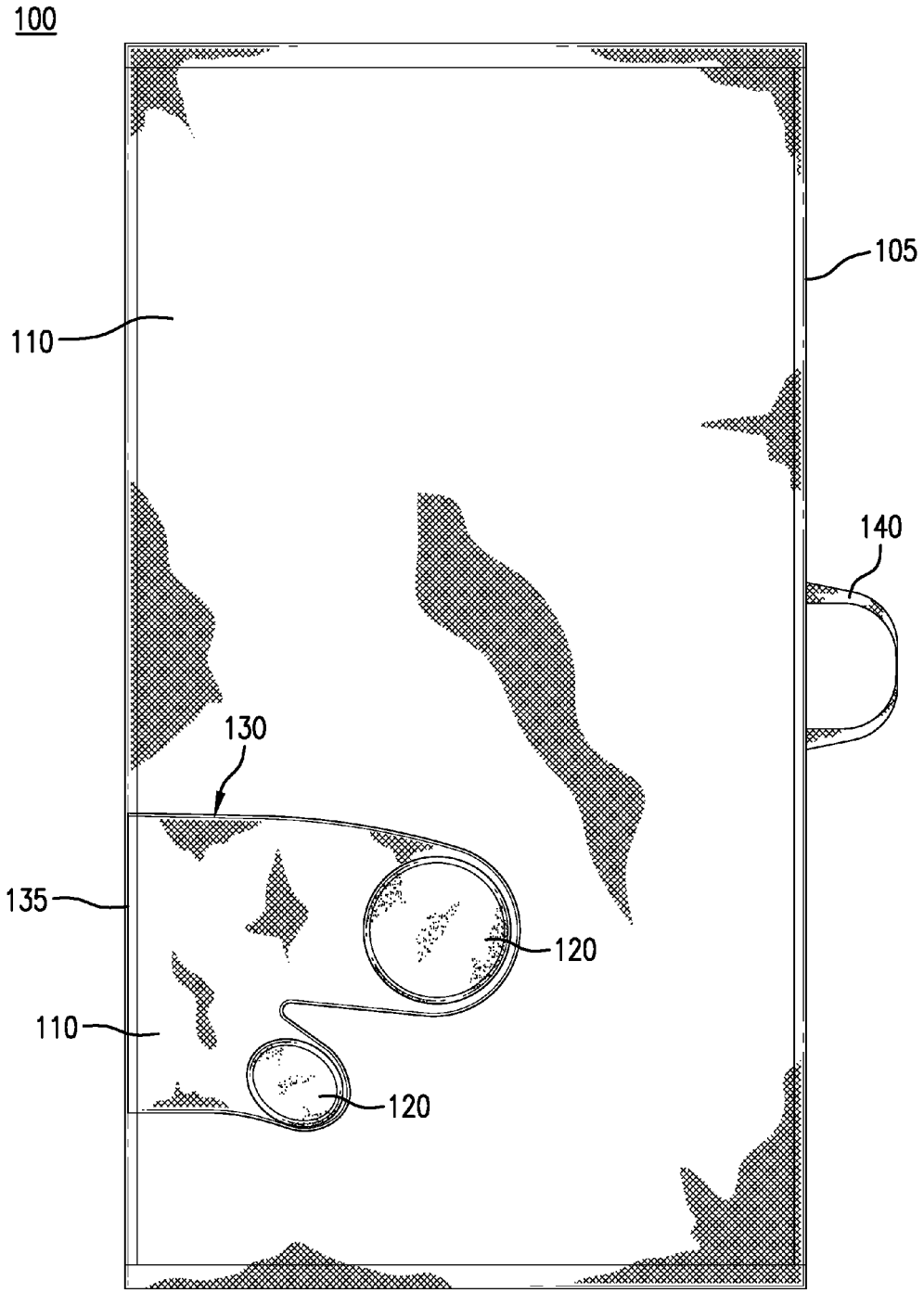
FIG. 2 shows a front view of a first side of a cleaning apparatus, according to an embodiment of the invention.
Figure 3:
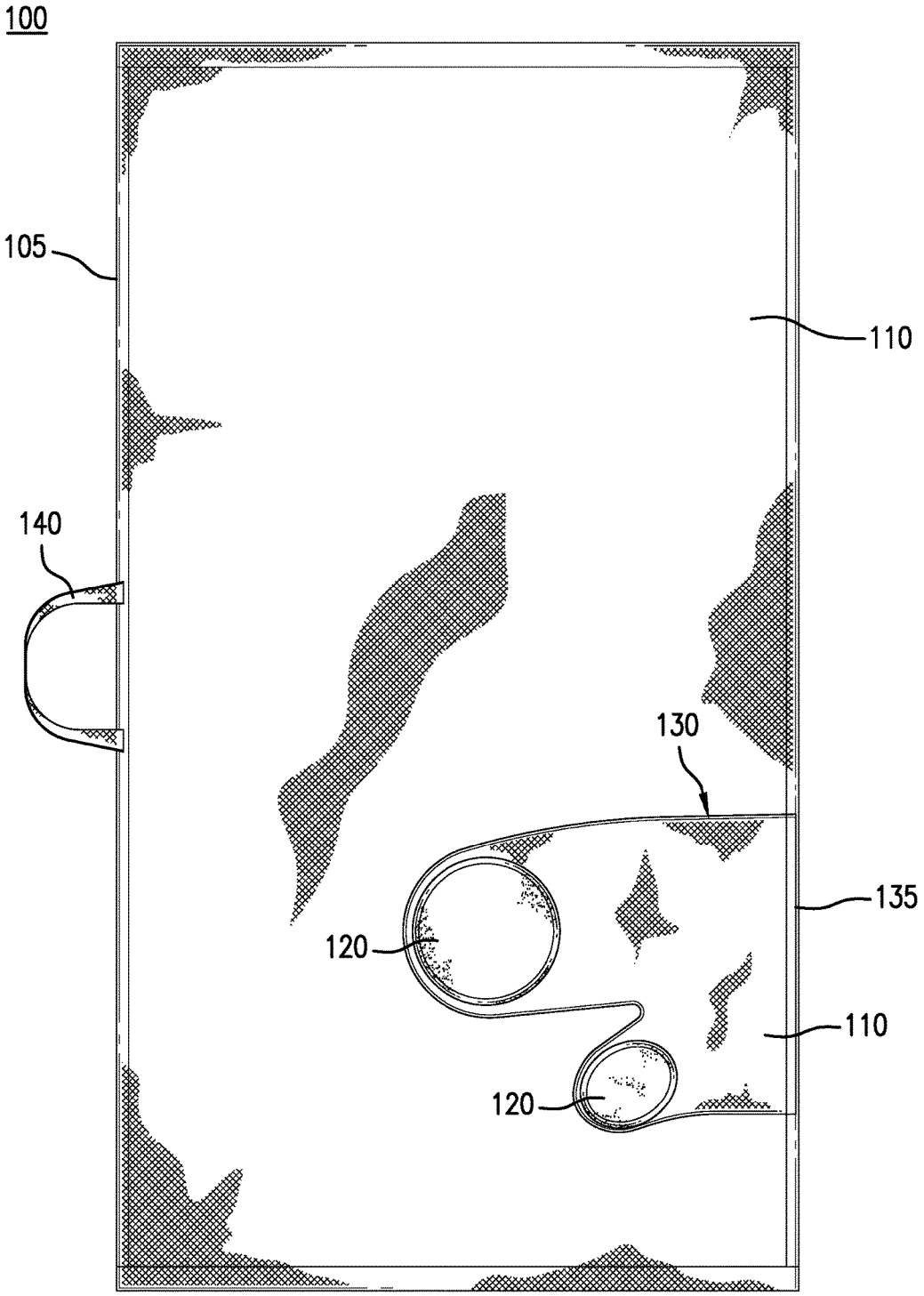
FIG. 3 shows a back view of a second side of a cleaning apparatus, according to an embodiment of the invention.

Referring now to FIGS. 2-3, a front view of a first side (FIG. 2) of the cleaning apparatus 100 and a back view of a second side (FIG. 3) of the cleaning apparatus 100 are illustratively depicted, in accordance with embodiments of the present invention.

According to an embodiment, the compartment 130 extends from the first side to the second side of the cleaning apparatus 100. According to another embodiment, the second textured surface 120 is positioned over portions of the compartment 130 designated for the thumb and at least one finger of the user on the first side of the cleaning apparatus 100 and the second side of the cleaning apparatus 100.

Figure 4:
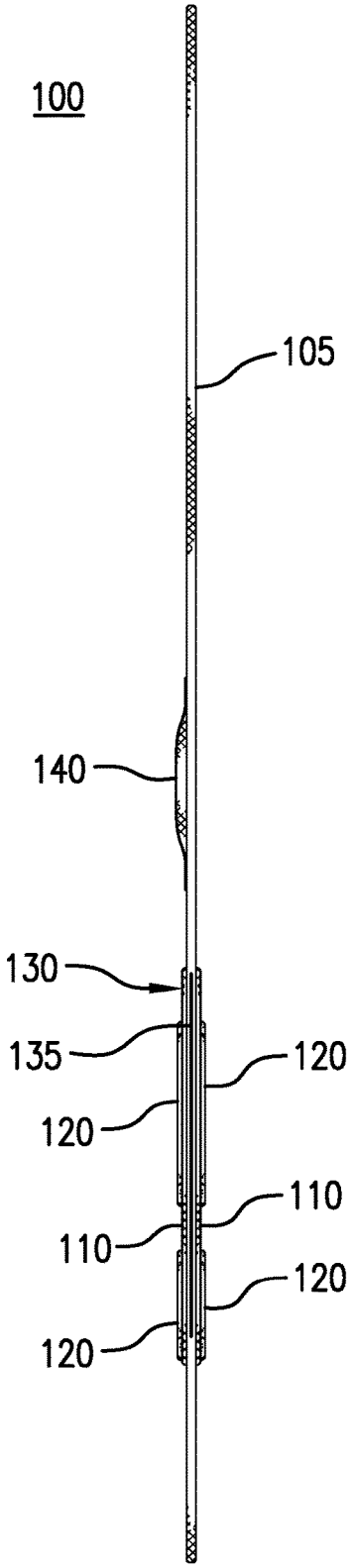
FIG. 4 shows a bottom view of a cleaning apparatus, according to an embodiment of the present invention.
Figure 5:
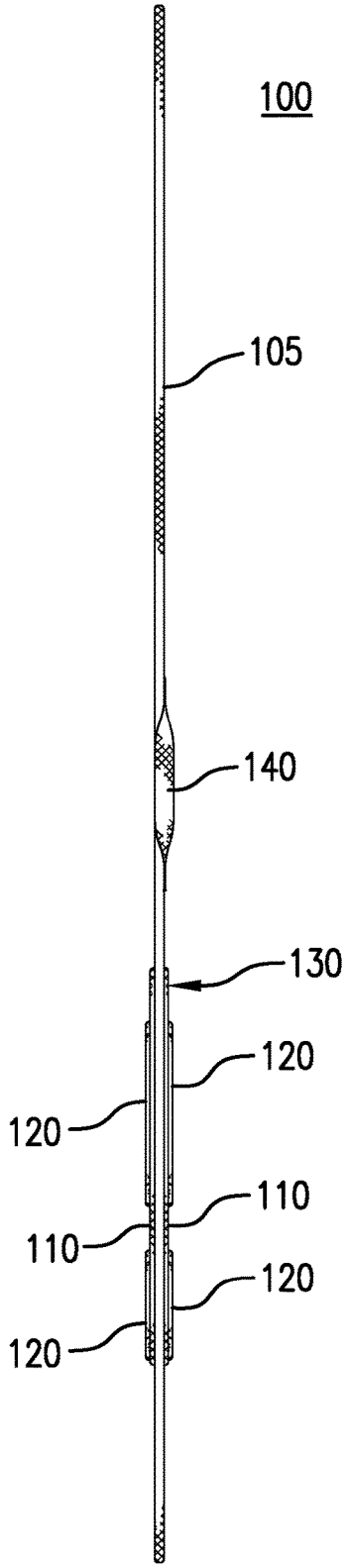
FIG. 5 shows a top view of a cleaning apparatus, according to an embodiment of the present invention.

Referring now to FIGS. 4-5, a top view (FIG. 4) and a bottom view (FIG. 5) of the cleaning apparatus 100 are illustratively depicted, in accordance with embodiments of the present invention.

Figure 6:
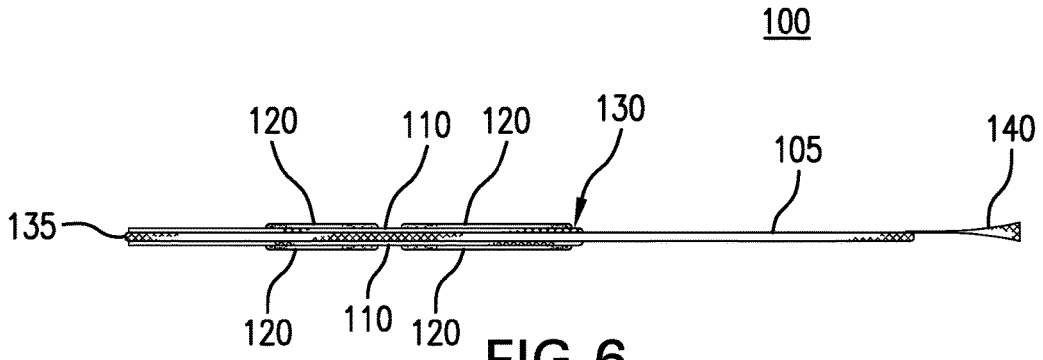
FIGS. 6-7 show side views of a cleaning apparatus, according to embodiments of the present invention.
Figure 7:
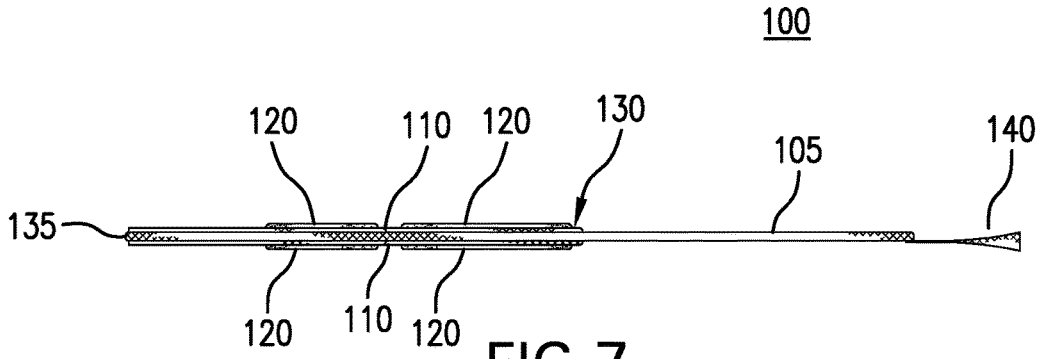

Referring now to FIGS. 6-7, side views of the cleaning apparatus 100 are illustratively depicted, in accordance with embodiments of the present invention.

According to an embodiment, the second textured surface 120 is placed over the first textured surface 110. According to embodiments shown in FIGS. 4-7, the second textured surface 120 protrudes farther out from a central axis of the cleaning apparatus 100 than the first textured surface 110. According to other embodiments, the second textured surface 120 is flush with the first textured surface 110.

Figure 8:
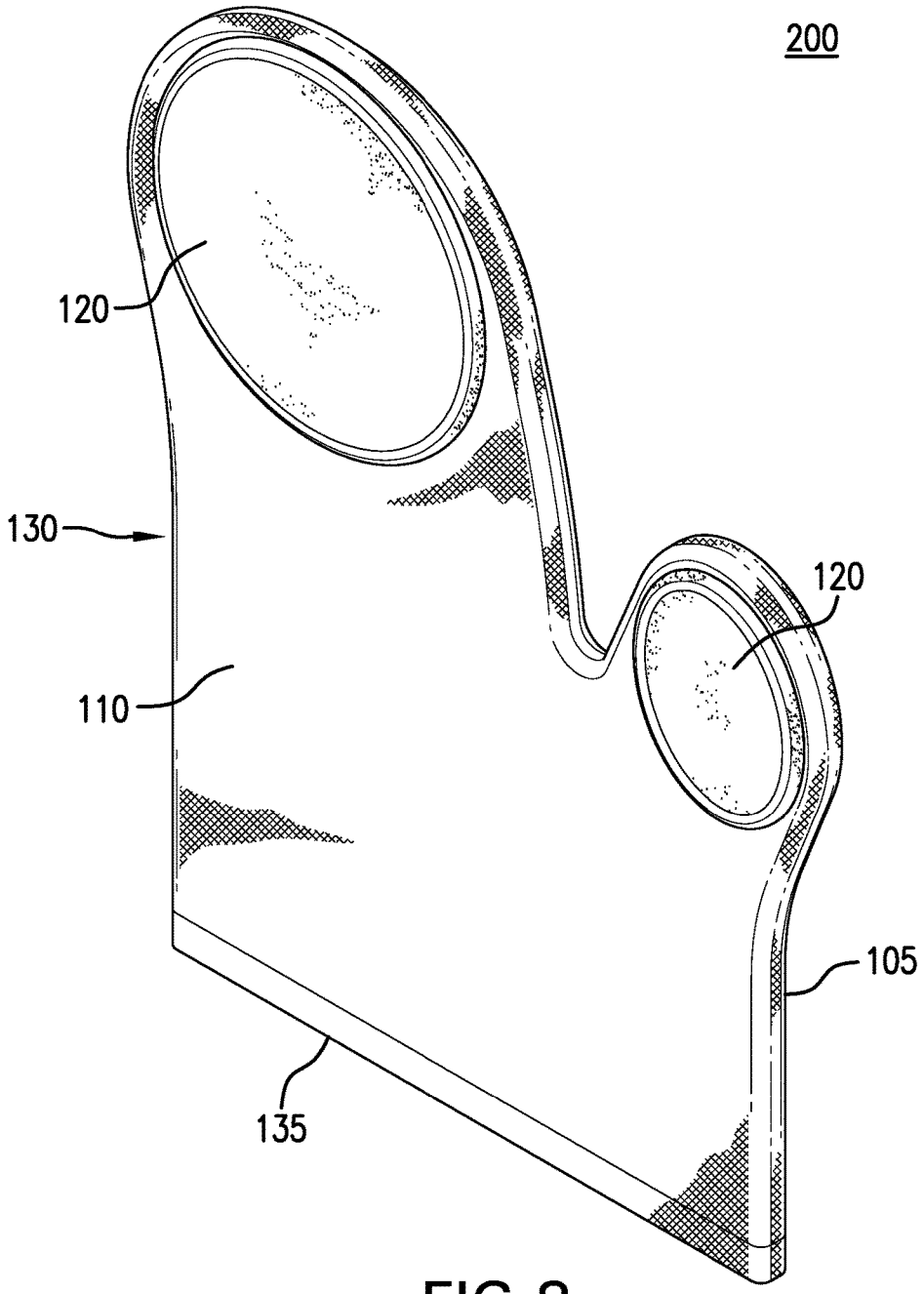
FIG. 8 shows a perspective view of a cleaning apparatus, according to an embodiment of the invention.

Referring now to FIG. 8, a perspective view of a cleaning apparatus 200 is illustratively depicted, in accordance with an embodiment of the present invention.

According to an embodiment, the cleaning apparatus 200 includes a cloth 105 having a first textured surface 110 and a second textured surface 120. According to an embodiment, the second textured surface is coarser than the first textured surface. According to various embodiments, the second textured surface 120 includes a material different from at least one of the materials in the first textured surface 110. According to an embodiment, the second textured surface 120 may be an abrasive. One or more components of the cleaning apparatus may be composed of a cloth material, such as, for example, toweling material. However, other materials having similar qualities may also be used, while maintaining the spirit of the present invention.

According to an embodiment, the cleaning apparatus 200 includes a compartment 130 housed within the cloth 105. According to an embodiment, the compartment 130 is stitched into the cloth 105. However, other methods of forming the compartment 130 within the cloth 105 may also be used, while maintaining the spirit of the present invention. According to the embodiment shown in FIGS. 8-14, the compartment 130 encompasses the entire area, or a majority of the area, of the cleaning apparatus 200.

According to an embodiment, the compartment 130 is configured to house the hand of a user, and has an opening 135 for the insertion of the hand. According to the embodiment shown in FIG. 1, the compartment 130 is in the shape of a mitten. However, other suitable shapes, such as the shape of a glove, may also be implemented into the compartment 130.

According to an embodiment, the second textured surface 120 is positioned over the compartment 130. According to an embodiment, the textured surface 120 is positioned over portions of the compartment 130 designated for the thumb and at least one finger of the user. This enables the user, after inserting a hand into the compartment 130, to rub the coarser-textured or polishing second textured surface 120 against any items that are being cleaned by the cleaning apparatus 200. The first textured surface 110, being less coarse than the second textured surface 120, may be used for drying. However, the first textured surface 110 may be used for other purposes, while maintaining the spirit of the present invention.

According to an embodiment, the compartment 130 includes an inner lining. The inner lining may be made from one of the same materials as the cloth 105, or may include one or more different materials. According to an embodiment, the inner lining may include a waterproof material. This waterproof materials may create a waterproof seal.

Figure 9:
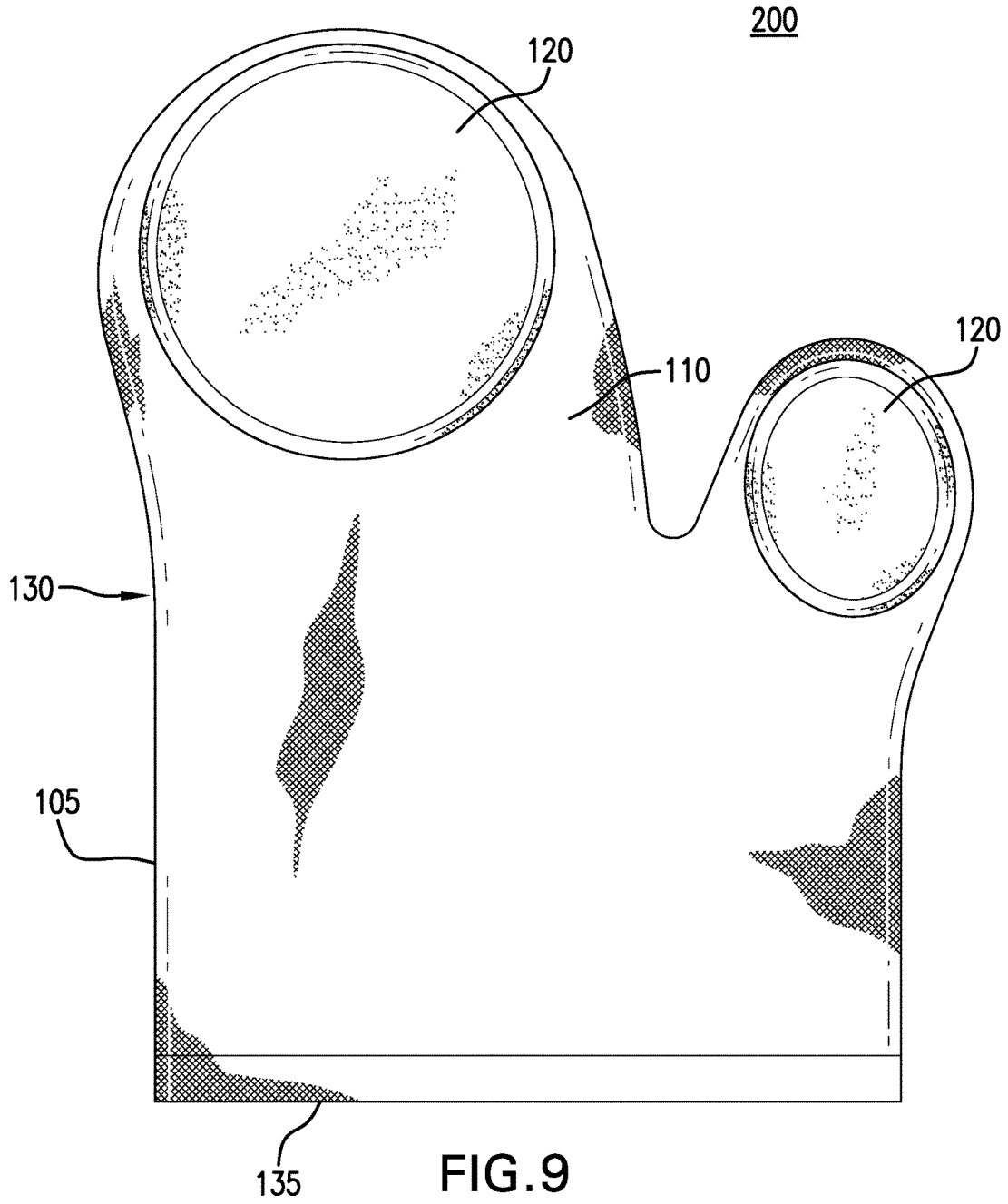
FIG. 9 shows a front view of a first side of a cleaning apparatus, according to an embodiment of the invention.
Figure 10:
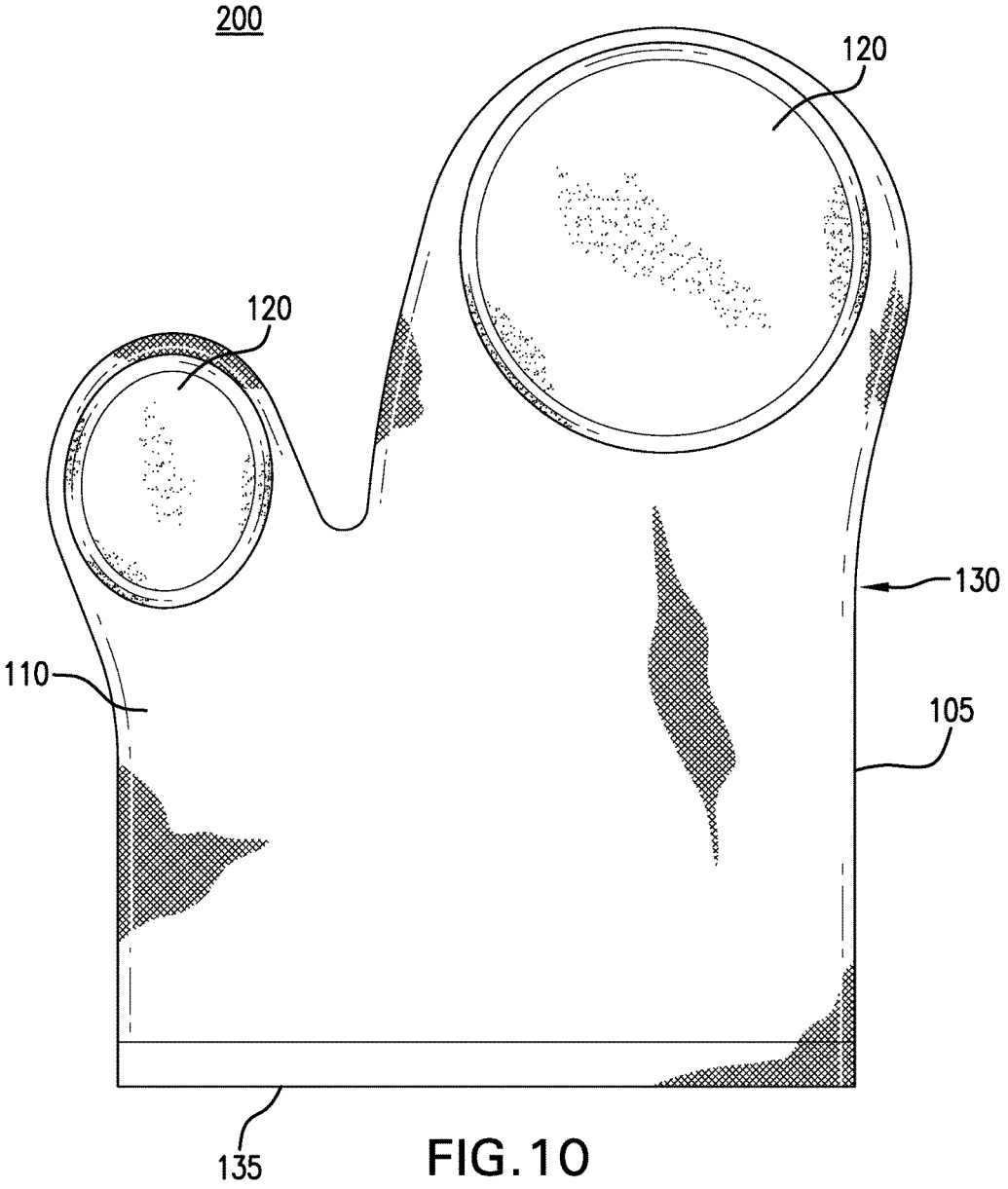
FIG. 10 shows a back view of a second side of a cleaning apparatus, according to an embodiment of the invention.

Referring now to FIGS. 9-10, a front view of a first side (FIG. 9) of the cleaning apparatus 200 and a back view of a second side (FIG. 10) of the cleaning apparatus 200 are illustratively depicted, in accordance with embodiments of the present invention.

According to an embodiment, the compartment 130 extends from the first side to the second side of the cleaning apparatus 200. According to another embodiment, the second textured surface 120 is positioned over portions of the compartment 130 designated for the thumb and at least one finger of the user on the first side of the cleaning apparatus 200 and the second side of the cleaning apparatus 200.

Figure 11:
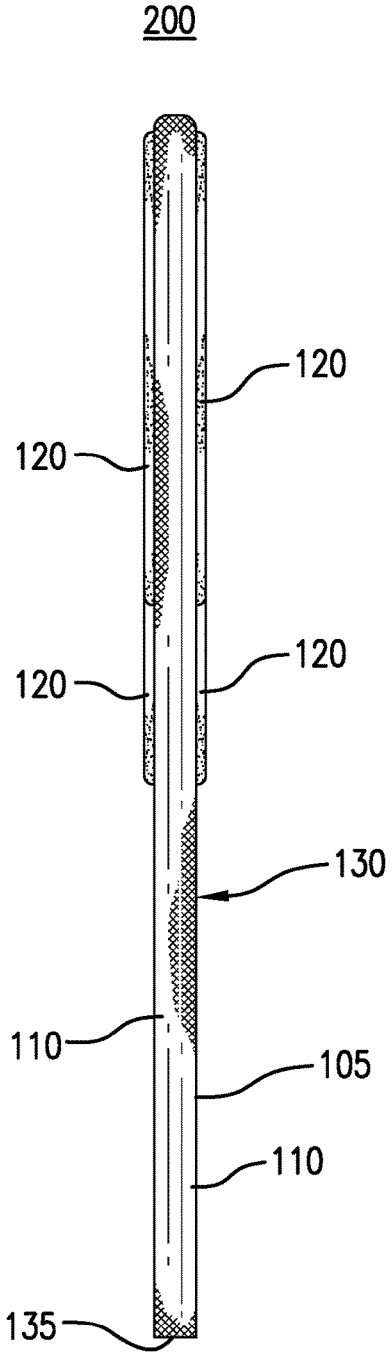
FIGS. 11-12 show side perspective views of a cleaning apparatus, according to embodiments of the present invention.
Figure 12:
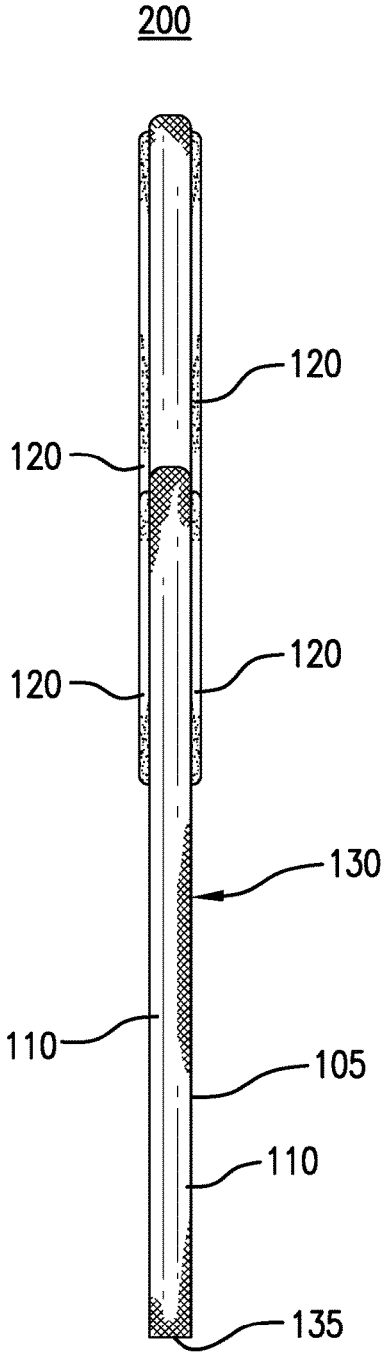

Referring now to FIGS. 11-12, side views of the cleaning apparatus 200 are illustratively depicted, in accordance with embodiments of the present invention.

Figure 13:
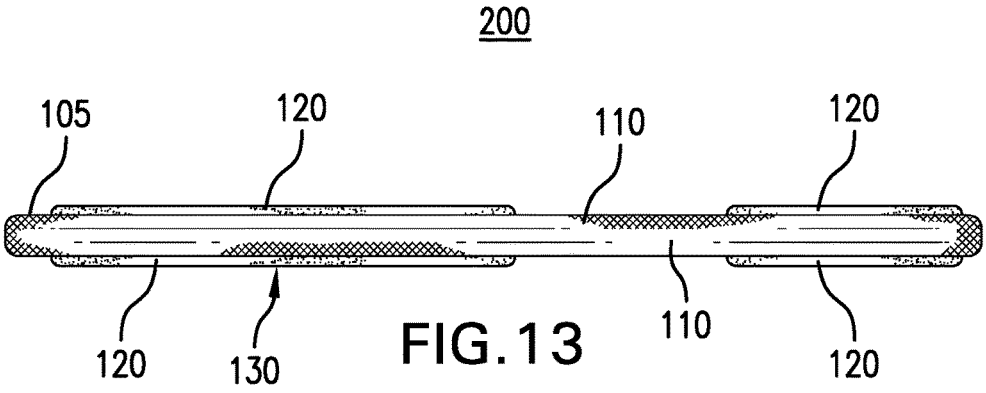
FIG. 13 shows a top view of a cleaning apparatus, according to an embodiment of the present invention.
Figure 14:
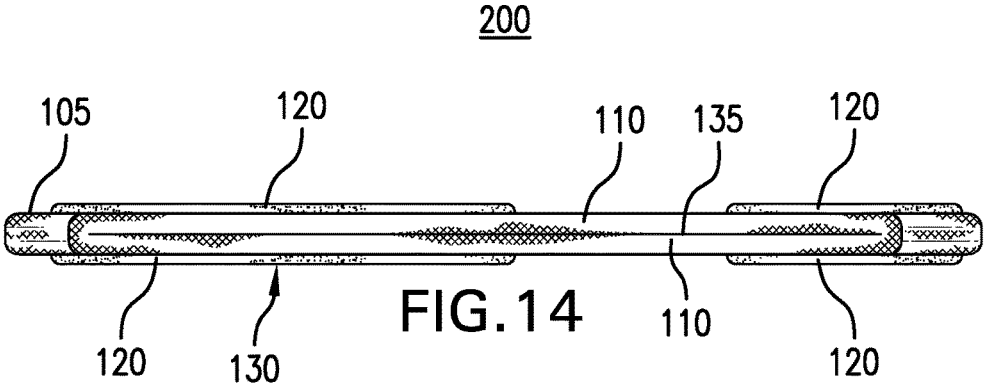
FIG. 14 shows a bottom view of a cleaning apparatus, according to an embodiment of the present invention.

Referring now to FIGS. 13-14, a top view (FIG. 13) and a bottom view (FIG. 14) of the cleaning apparatus 200 are illustratively depicted, in accordance with embodiments of the present invention.

According to an embodiment, the second textured surface 120 is placed over the first textured surface 110. According to embodiments shown in FIGS. 11-14, the second textured surface 120 protrudes farther out from a central axis of the cleaning apparatus 200 than the first textured surface 110. According to other embodiments, the second textured surface 120 is flush with the first textured surface 110.

The many elements of the present invention make it unique in the field. The novelty is illustrated by the various options for nearly every aspect of the invention that allow it to be used in the proper exercise form by a variety of users, both in terms of body size and fitness level. Additionally, there is a wide range of exercises available to any user of the present invention, and users can perform exercises that use the upper and lower extremity muscle groups simultaneously.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A golf towel comprising:

a rectangular cloth having an abrasive material and a polishing material disposed thereon, wherein the abrasive material is coarser than the polishing material; and a compartment coupled to the rectangular cloth, the compartment consisting of a first lobe and a second lobe, wherein the compartment has an opening along an edge of the cloth, wherein the compartment is configured to enclose a hand of a user;

wherein the polishing material is disposed on a portion of the first lobe of the compartment and a portion of the second lobe of the compartment on a front side of the rectangular cloth;

wherein the abrasive material is disposed on a portion of the first lobe of the compartment and a portion of the second lobe of the compartment on a back side of the rectangular cloth.

2. The golf towel as recited in claim 1, wherein the cloth includes a toweling material.

3. The golf towel as recited in claim 1, wherein the abrasive material has a different texture than that of the polishing material.

4. The golf towel as recited in claim 1, wherein the abrasive material includes a material different from the polishing material.

5. The golf towel as recited in claim 1, wherein the abrasive material includes a color different from a color of the polishing material.

6. The golf towel as recited in claim 1, wherein the compartment includes an inner lining.

7. The golf towel as recited in claim 6, wherein the inner lining includes a material different from that of the cloth.

8. The golf towel as recited in claim 6, wherein the inner lining includes a waterproof material.

9. The golf towel as recited in claim 8, wherein the inner lining creates a waterproof seal.

10. The golf towel as recited in claim 1, wherein the compartment is sewn into the cloth.

11. The golf towel as recited in claim 1, further comprising a handle coupled to the cloth.

12. The golf towel as recited in claim 11, wherein the handle is of a sufficient length to enable the user to pull a portion of the cloth through an opening formed by the handle.

13. A golf towel comprising:

a rectangular cloth having a periphery, a front side, and a back side;

a compartment coupled to the rectangular cloth, the compartment consisting of a first lobe and a second lobe with the first lobe being larger than the second lobe, wherein the compartment is located between the front side and the back side of the rectangular cloth, and wherein the compartment has an opening along an edge of the periphery of the rectangular cloth;

a circular polishing material disposed on a portion of the first lobe of the compartment and a portion of the second lobe of the compartment on the front side of the rectangular cloth, wherein a top surface of the circular polishing material is flush with a top surface of the front side of the rectangular cloth;

a circular abrasive material disposed on a portion of the first lobe of the compartment and a portion of the second lobe of the compartment on the back side of the rectangular cloth, wherein the circular abrasive material is coarser than the circular polishing material, and wherein a top surface of the circular abrasive material is raised above a top surface of the back side of the rectangular cloth.

14. The golf towel of claim 13 wherein a material forming the rectangular cloth is less coarse than the circular abrasive material.

15. The golf towel of claim 13 wherein the compartment is offset from a midline of the rectangular cloth.

16. The golf towel of claim 13 wherein the circular polishing material and the circular abrasive material are disposed such that each of the first lobe and the second lobe are exposed on all sides of a periphery of the circular polishing material and a periphery of the circular abrasive material.

* * * * *